US005135224A

United States Patent [19]

Yamamoto et al.

[11] Patent Number: 5,135,224

[45] Date of Patent: Aug. 4, 1992

[54] PATTERN MATCHING GAME MACHINE OF PREPAID CARD SYSTEM

[75] Inventors: Hiroshi Yamamoto; Kiyomi Iwai, both of Tokyo, Japan

[73] Assignees: Leisure Create Co., Ltd., Tokyo; Newgin Co., Ltd., Aichi, both of Japan

[21] Appl. No.: 641,133

[22] Filed: Jan. 15, 1991

[51] Int. Cl.[5] ..... A63B 71/06

[52] U.S. Cl. ..... 273/143 R; 273/138 A

[58] Field of Search ..... 273/143 R, 138 A

[56] References Cited

U.S. PATENT DOCUMENTS 4,575,622 3/1986 Pellegrini ..... 273/138 A
4,689,742 8/1987 Troy et al. ..... 273/138 A
4,889,339 12/1989 Okada ..... 273/143 R

FOREIGN PATENT DOCUMENTS 2068620 8/1981 United Kingdom ..... 273/143 R

*Primary Examiner*—Benjamin Layno
*Attorney, Agent, or Firm*—Spencer, Frank & Schneider

[57] ABSTRACT

A pattern matching game machine of a prepaid card system including a plurality of pattern display units mounted on a shaft and arranged in parallel to one another, a drive motor for driving the display units under the control of a control circuit, a magnetic card reader and a card identification circuit. The control circuit includes a CPU (central processor unit), an operation circuit connected to said CPU, a printer for printing out the prize points scored by a player, a motor drive circuit for driving the display units based on the random number pulses and pulse signals, and a judgement circuit for judging whether or not the patterns on the display units are matched, whereby prize points are credited when the patterns are matched instead of discharging coins, and the prize points are printed out on a slip of paper when a signal indicating the end of a game is emitted.

4 Claims, 5 Drawing Sheets

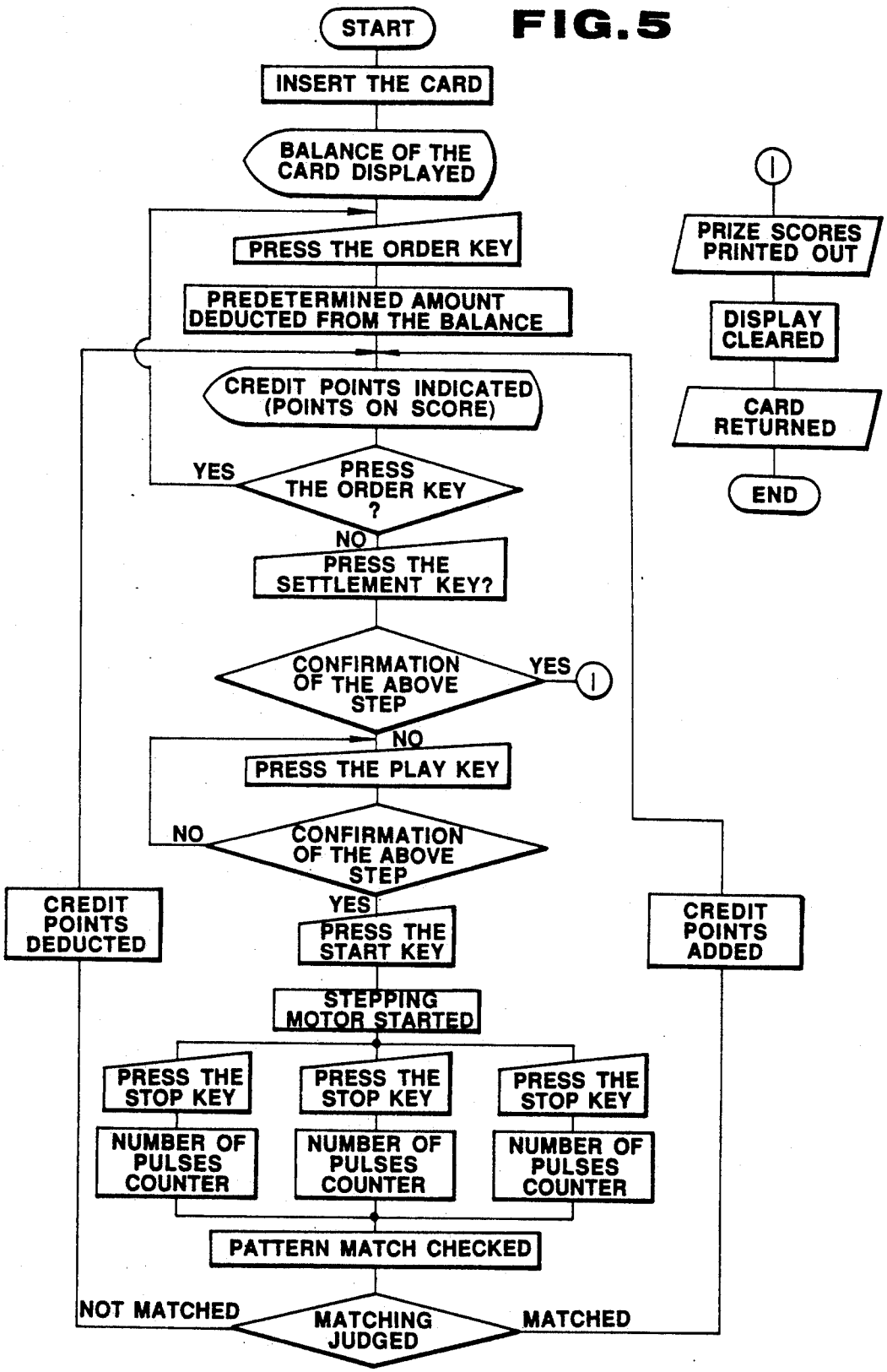
FIG. 5
START
INSERT THE CARD
BALANCE OF THE CARD DISPLAYED
PRESS THE ORDER KEY
PREDETERMINED AMOUNT DEDUCTED FROM THE BALANCE
CREDIT POINTS INDICATED (POINTS ON SCORE)
YES
PRESS THE ORDER KEY ?
NO
PRESS THE SETTLEMENT KEY?
CONFIRMATION OF THE ABOVE STEP
YES
NO
PRESS THE PLAY KEY
NO
CONFIRMATION OF THE ABOVE STEP
YES
PRESS THE START KEY
STEPPING MOTOR STARTED
PRESS THE STOP KEY
PRESS THE STOP KEY
PRESS THE STOP KEY
NUMBER OF PULSES COUNTER
NUMBER OF PULSES COUNTER
NUMBER OF PULSES COUNTER
PATTERN MATCH CHECKED
NOT MATCHED
MATCHING JUDGED
MATCHED
CREDIT POINTS DEDUCTED
CREDIT POINTS ADDED
PRIZE SCORES PRINTED OUT
DISPLAY CLEARED
CARD RETURNED
END

PATTERN MATCHING GAME MACHINE OF PREPAID CARD SYSTEM

BACKGROUND OF THE INVENTION

The present invention relates to game machines of a slot machine type which do not require use of metal coins. More particularly, it relates to game machines comprising more than one rotary member, on which several kinds of graphic patterns and signs are depicted so that a player wins prize coins by the number of matched patterns when he stops the rotation of the rotary members at an arbitrary time.

PRIOR ART

Conventional game machines of pattern matching (such as slot machine) include those on which a player feeds coins through the coin slot, pulls down the arm to cause the rotary members carrying different patterns to rotate, and wins or loses a number of prize coins depending on the combinations of the patterns when the rotary members stop rotating.

With the game machine of this type, a player must feed coins through the coin slot and, when finished playing, must carry the coins including prize coins to a prize exchange station.

OBJECTS

The conventional game machines of this type entailed various inconveniences for both the players and the operators of the machines. The inconveniences include the following.

For the player, use of coins obliges him to pick up the coins from the coin return, feed them piece by piece and carry a large number of coins to the prize exchange station for settlement.

For the operator, use of coins is inconvenient in that he must supply the coins inside each machine in advance, and that a machine may run out of coins during a game, obliging the player to stop playing and the operator to supply the coins again.

The operator is also obliged to employ personnel for keeping an eye on the players to prevent them from using counterfeit coins or other than those belonging to his machines, for counting coins brought to the prize exchange station for an accounting and for exchanging them for prizes. Moreover, as the coins come in contact with many people or may drop on the floor, they require daily cleansing for reasons of sanitation.

In view of the inconveniences encountered in the prior art, the present invention aims at providing game machines which do not require use of coins that were indispensable in the prior art, so that there will be no need for transporting, cleansing, exchanging, or counting the coins.

SUMMARY OF THE INVENTION

To achieve the above-mentioned objects, the present invention includes plural pattern display units mounted on a shaft side-by-side and each comprising a rotary or endless belt member on which graphic patterns are depicted, operation of the pattern display units being controlled by a drive motor which in turn is under the control of a control circuit Said control circuit comprises a magnetic card reader, a card identification circuit which identifies data read by the reader, a CPU (central processor) to which data at the identification circuit are transmitted, an operation circuit which is connected to said CPU and which carries out various operations such as player entry, and initiating or terminating a game, a display which is connected to said operation circuit and displays the score of the player, a printer which prints out the score, a random number circuit which is connected to the CPU and transmits start/stop signals to a motor drive circuit upon receipt of more than one random number from the CPU, a motor drive circuit which controls the motors for driving the rotary or endless belt members in accordance with pulse signals from the CPU and the random number pulses transmitted from the random number circuit, and a judgment circuit which judges the matching of the patterns on the pattern display units. The game machine according to the present invention is characterized in that when the patterns are matched, prize points are credited on the score instead of discharging coins, and the score is printed out when the termination signal is generated.

According to the present invention, a player buys a prepaid card and inserts the card into the card reader, whereupon the card reader checks the validity of the card and displays the balance of the card on the display.

By checking the balance on the display, the player presses the "credit" key to credit an amount of money to play several games. Instead of feeding coins, he presses the "play" key and the fee for one game is deducted from the credited amount, and the pattern display units with patterns start revolving. When the player presses the "stop" keys for the respective display units at arbitrary times the respective display units stop revolving and a pattern will be displayed on each unit.

The judgment circuit judges matching or special combinations of the displayed patterns, and if a matching or bonus combination of the displayed patterns exist, then prize points are added as the player's score.

A player can thus enjoy a game by manipulating the "play" key and the "stop" key on the pattern display units, and the score increases/decreases as the game proceeds.

To terminate the games, the player merely presses the "account" key, and the points he has so far won are printed on a sheet of paper. He may merely take the slip of paper to the prize exchange station.

BRIEF DESCRIPTION OF THE DRAWINGS

FIG. 5 is a flow chart to show the operation of the game machine.

DETAILED DESCRIPTION OF THE PREFERRED EMBODIMENT

Figure 1:
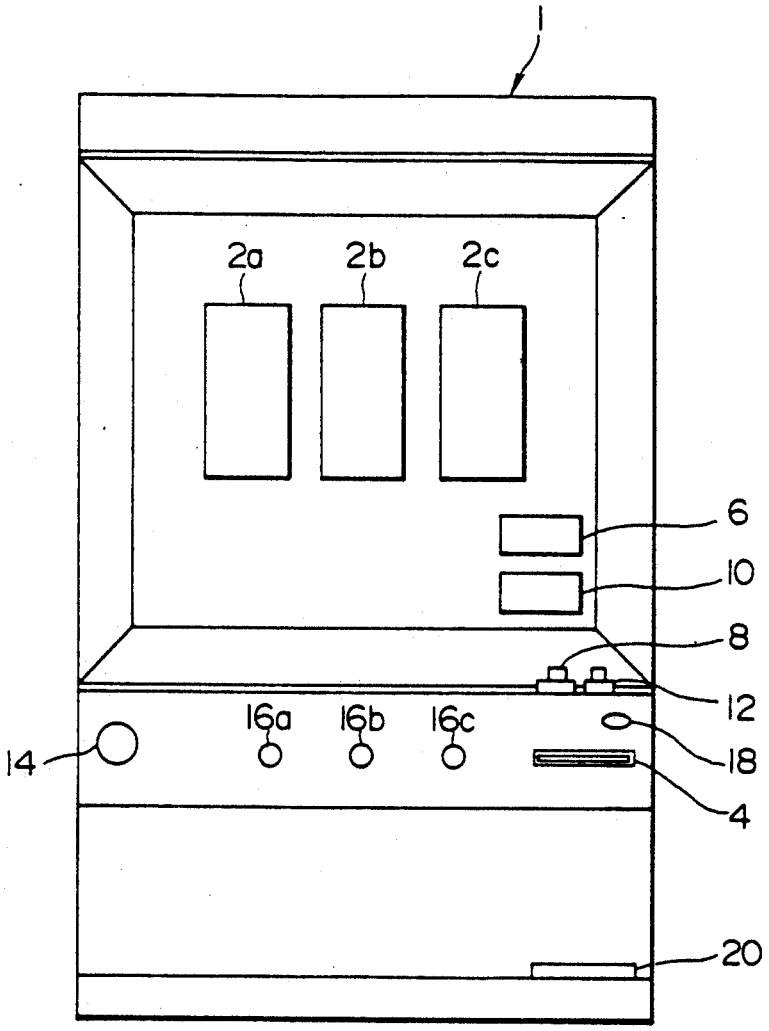
FIG. 1 is a front view to show an embodiment of the game machine according to the present invention.

The present invention will now be described in more detail referring to one embodiment shown in the attached drawings.

In the figures, reference number 1 denotes a card-operated slot machine which is one embodiment of a card-operated game machine according to the present invention. Pattern display units 2a, 2b and 2c comprising rotary members are arranged at the center of the slot machine 1. There is provided a slit 4 for inserting a prepaid card. The balance recorded on the prepaid card is indicated on a display 6. When an "order" key 8 for investing a given amount of money into the machine 1 is pressed, points or the like are displayed on a "credit" display 10 to be credited on the machine.

The reference number 12 denotes a "play" key which a player presses to proceed with a game. Each time the key 12 is pressed, one point is deducted from the score on the credit display 10 and the machine 1 stands ready for a game.

The reference number 14 denotes a "start" key for starting the rotary members with the patterns. "Stop" keys 16a, 16b and 16c are provided so that the player may arbitrarily stop the rotation of the rotary members.

An "account" key 18 allows the player to settle his stake when the game is terminated. When the key 18 is pressed, a printer prints out the settled points, and the score is outputted from an output port 20.

Figure 2:
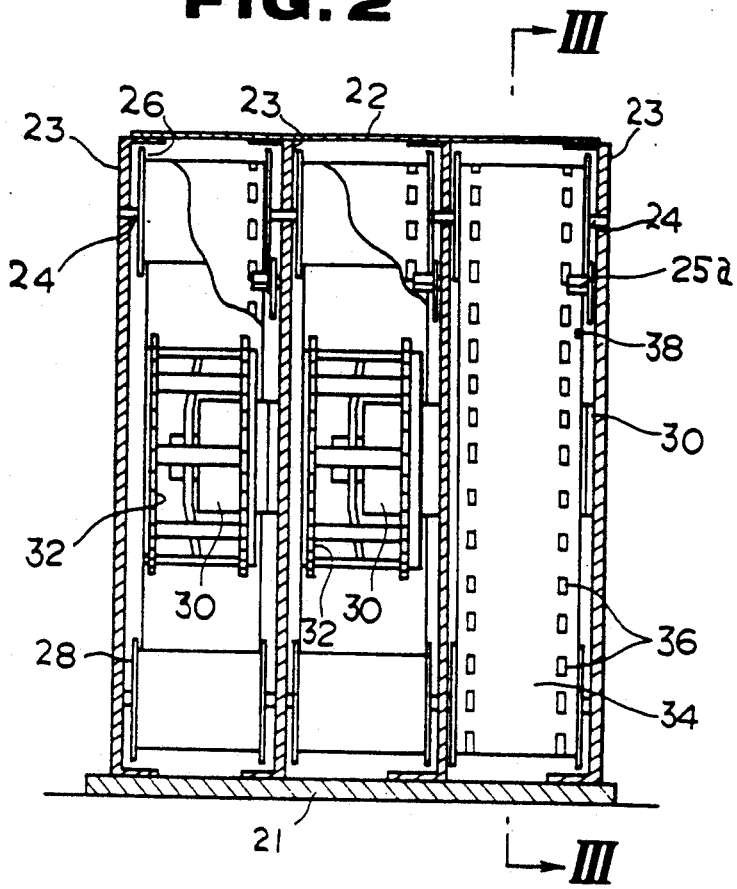
FIG. 2 is a partially exploded front view to show the belt driving mechanism.
Figure 3:
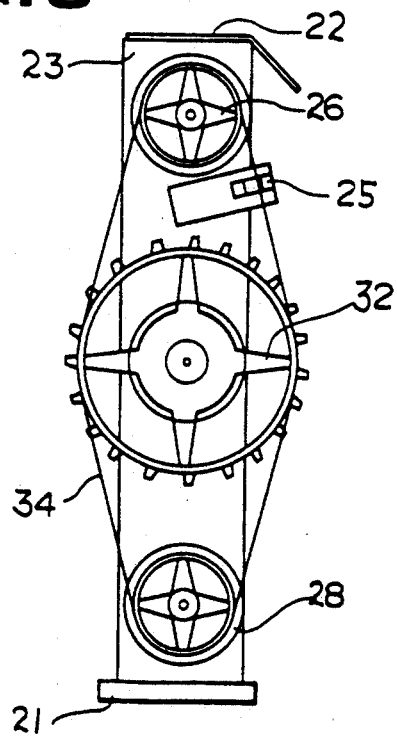
FIG. 3 is a sectional view along the line III—III in FIG. 2.

The rotary unit with patterns in this embodiment includes a plurality of rotary members arranged side-by-side each comprising, as shown in FIGS. 2 and 3, an endless belt 34 provided with perforations 36 along the opposite sides thereof at regular intervals, a pair of belt pulleys 26, 28 around which the endless belt is suspended, a sprocket wheel 32 which is disposed substantially at a midpoint between the pulleys 26 and 28 and which engages with the perforations 36, and a stepping motor 30 which drives said sprocket wheel 32. The rotary unit further includes a belt driving mechanism comprising a motor driving circuit 54 (FIG. 4) which drives respective stepping motor of each rotary unit independently. In each rotary unit, the toothed wheel 32 disposed between the belt pulleys 26, 28 is larger than the pulleys (twice as large in the drawing) and has a circumference half as long as the belt 24. A base 21 is provided to support the driving mechanism. The space between the base 21 and an upper plate 22 is sectioned into three blocks by means of partitions 23. On a shaft 24 extending between the partitions 23 are axially mounted the belt pulleys 26, 28. A notch 38 on one side of the endless belt 34 acts as a means to indicate the belt position. Detector means 25a, 25b and 25c for detecting the position are provided along the track of the endless belt 34 to detect the notch 38 as it passes.

Figure 4:
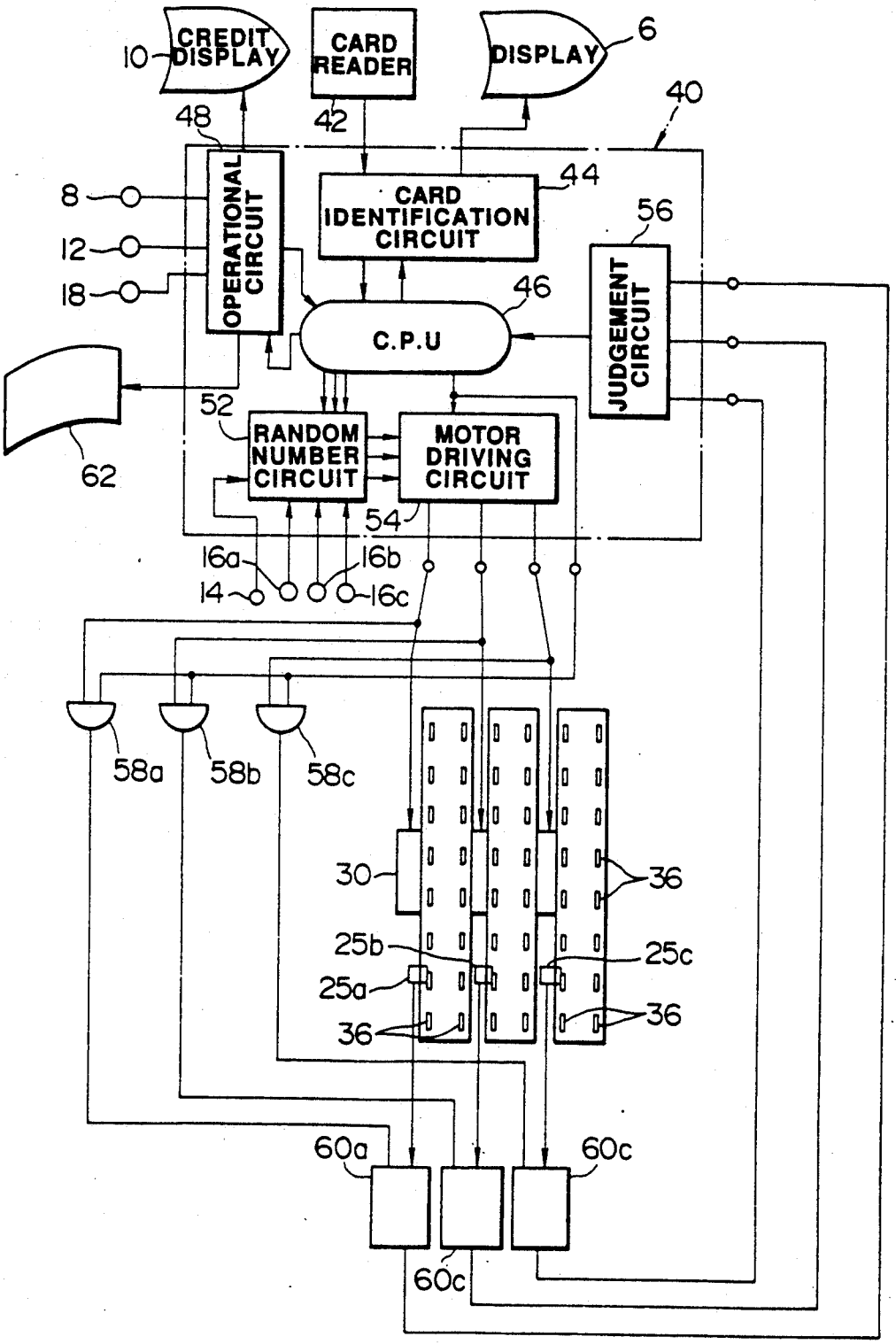
FIG. 4 is a circuit diagram.

FIG. 4 is a circuit diagram to show the entire machine. The reference number 40 denotes a control circuit which controls the operations of the game machine as a whole. The control circuit 40 comprises a card identification circuit 44 which identifies the data read by a card reader 42, a CPU 46 which receives card data identified and transmitted by the circuit 44, an operation circuit 48 which is connected to the CPU 46 and which controls the operations of an "order" key 8, a "play" key 12 and "account" key 18 respectively, a random number circuit 52 which outputs start/stop signals in response to random numbers generated by the CPU 46 to the motor driving circuit 54 as well as controls a "start" key 14 and a "stop" key 16 for the rotary units, a motor driving circuit 54 which supplies electric current to stepping motors 30 of the belt driving mechanism in accordance with the pulses generated by the CPU 46, and a judgment circuit 56 which judges matching of the patterns when the belt driving mechanism stops operating. The judgment circuit 56 is connected with AND gates 58a, 58b and 58c which carry out logical multiplications of the pulses supplied at the stepping motor 30 with the pulses generated by the CPU 46, and with pulse counters 60a, 60b and 60c which are connected to said AND gates 58a, 58b and 58c and which count the pulses following clearing signals transmitted from the position detectors 25a, 25b and 25c provided at the end of each endless belt 30. Based on the relation between the positional relations of the patterns which are depicted on the endless belts and inputted in advance at the judgment circuit and the number of pulses, the judgment circuit 56 judges matching of the patterns.

The reference number 62 denotes a printer.

In the slot machine of the above construction embodying the present invention, a game proceeds as shown in the flow chart of FIG. 5. A player inserts a prepaid card into a card slit 4 of the card reader 42. The card identification circuit 44 determines whether the card is valid or not, reads out the balance remaining on the card and indicates the amount on the balance display 6. The player confirms the balance on the display 6 and presses the "order" key 8 instead of throwing in coins, whereupon a predetermined amount of monetary value is deducted from the balance recorded on the card and a given amount of points is indicated on the credit display 10 of the slot machine. If the player feels the credit points indicated on the display 10 are not enough, then he can press the "order" key 8 to increase the same.

A game starts when the player presses the "play" key 12. As he presses the "start" key 14, each endless belt 34 starts revolving independently and stops as the player presses the stop keys 16a, 16b and 16c respectively.

Each endless belt 34 does not stop instantaneously. The machine is so constructed that each stepping motor 30 is driven to rotate for the number of steps corresponding to the random number output by the CPU 46 and selected by the random circuit 52 when each stop key 16a, 16b or 16c is pressed.

The notch 38 provided at the edge of each endless belt 34 is detected by respective position detector 25a, 25b or 25c. Each pulse counter 60a, 60b or 60c counts the number of pulses supplied to the stepping motor 30 from the motor drive circuit 54 from the moment the notch 38 is detected until the endless belt 34 stops. The judgment circuit 56 judges the status of patterns on the endless belts 34 based on the counts counted by the circuits 60a, 60b and 60c. Thus, when the endless belts 34 stop, patterns thereon are checked as to whether they are matched or not. If any matches are found, they are credited as hits in the CPU and a predetermined number of prize points is added on the score on the display. If none is found, then a predetermined number of points is deducted from the score. Then, the player can resume a game by pressing the "play" key 12 to win or lose his prize points.

When the player wishes to cease playing, he can do so by pressing the "account" key 18, whereupon prize points so far scored are totalled and printed out on a slip of paper by the printer 62 in accordance with a predetermined form, and the prepaid card is returned to the player.

The player may bring the slip to the prize exchange station to receive his prizes according to his earned points.

Figure 6:
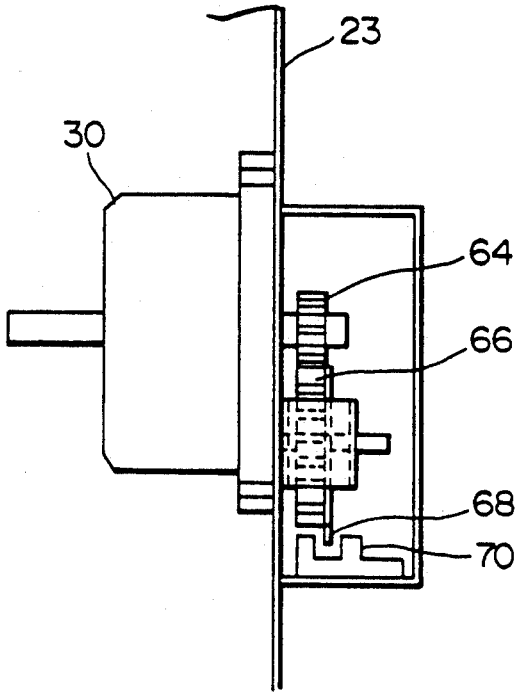
FIG. 6 is a side view to show a modified embodiment of a position detecting means according to the present invention.
Figure 7:
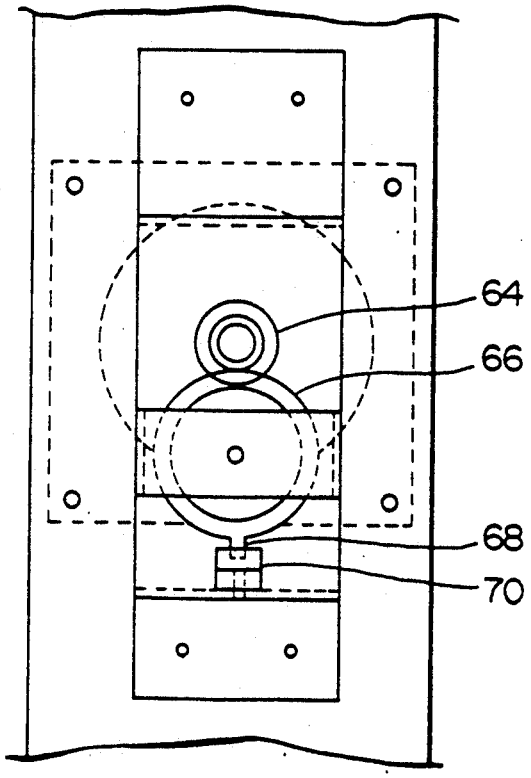
FIG. 7 is a front view to show engagement of the sprocket wheel thereof.

In this embodiment, a notch 38 is provided at the edge of each the endless belt on one side to detect the position. However, the present invention is not limited to this construction. As shown in FIGS. 6 and 7, it is also possible to transmit clearing signals to the pulse counter circuits 60*a*, 60*b* and 60*c* by providing a toothed wheel 64 which is mounted on the driving shaft of the stepping motor 30 and which has a number n of teeth (n is an integer), a toothed wheel 66 which engages with the toothed wheel 64 and which has 2n teeth, a projection 68 which projects from one end of the toothed wheel 66 in the direction of the outer periphery the photosensor 70 transmitting the clearing signals and a photosensor 70 when the projection 68 passes the photosensor 70. In this case, one rotation of the belt corresponds to one rotation of the toothed wheel 66. This construction reduces vibrations at the detector means due to rotation as compared with the detector means which utilizes the notch 38 provided on the endless belt, and realizes more accurate detection.

Although the points are deducted from the score when the game is initiated in this embodiment, it is also possible to do so after a game.

Although the embodiment has been described in terms of a slot machine, the present invention is also applicable to pinball game machines where pinballs are caused to circulate in the machine. The present invention is further applicable to any games which use graphical patterns. For example, if the endless belts are arranged in 5 rows, then the machine can be used as a poker game machine.

By connecting the CPU of the game machine utilizing prepaid cards to a central computer, sales on each game machine in a casino with the use of the prepaid cards can be easily totalled.

EFFECT

As has been described above, the slot machine using prepaid cards according to the present invention enables reduction of personnel as it does not involve the management of coins which was a must in the conventional game machines using coins.

Players are liberated from the trouble of feeding coins and thus are allowed to be more absorbed in the games.

By connecting the CPUs in the machines with a central computer, the status of use or sales of all of the machines in a casino can be easily monitored and totalled

What is claimed is:

1. A pattern matching game machine, comprising:

a plurality of pattern display units disposed side-by-side, each unit including a pair of spaced apart belt pulleys, each pulley having a diameter, an endless belt on which patterns are depicted, suspended about said pair of pulleys, perforations being formed at regular intervals in the belt along opposite side edges thereof, said belt having a perimeter, a sprocket wheel disposed midway between said belt pulleys so that sprockets on opposite sides of the sprocket wheel are engaged in the perforations on opposing portions of said belt, said sprocket wheel having a diameter twice the diameter of said pulleys and a circumference half the perimeter of said belt, and a stepping motor connected for rotating said sprocket wheel;

said machine further including:

a card reader which reads data on a player's card;

a prize point display which displays prize points credited to a player;

a detector means which detects positions of patterns while the belts are stationary;

a printer for printing out at an end of a game a number of prize points scored by the player; and a control circuit, including a card identification circuit which identifies data read by said card reader, an operation circuit connected to said display, said operation circuit controlling player entry into a game and initiating and terminating a game, a random number circuit, responsive to random numbers received thereby, for issuing start/stop signals, a motor drive circuit, responsive to the start/stop signals and drive pulse signals applied thereto, for driving the stepping motors, a CPU connected to said card identification circuit to receive card identification data from said card identification circuit, said CPU providing the random numbers to said random number circuit and the drive pulse signals to said motor drive circuit, and a judgment circuit which judges matching of patterns according to the positions of the patterns detected by the detector means, prize points being credited to the player when matches are judged by said judgment circuit.

2. The pattern matching game machine of a prepaid card system as claimed in claim 1 wherein each of said belt pulleys have radially extended flanges along its periphery on both sides.

3. A pattern matching game machine, comprising:

a plurality of pattern display units disposed side-by-side, each unit including a pair of spaced apart belt pulleys, each pulley having a diameter, an endless belt on which patterns are depicted, suspended about said pair of pulleys, perforations being formed at regular intervals in the belt along opposite side edges thereof, said belt having a perimeter, a sprocket wheel disposed midway between said belt pulleys so that sprockets on opposite sides of the sprocket wheel are engaged in the perforations on opposing portions of said belt, said sprocket wheel having a diameter twice the diameter of said pulleys and a circumference half the perimeter of said belt, and a stepping motor connected for rotating said sprocket wheel;

said machine further including:

a card reader which reads data on a player's card;

a prize point display which displays prize points credited to a player;

a detector means which detects positions of patterns while the belts are stationary;

a printer for printing out at an end of a game a number of prize points scored by the player; and a control circuit, including a card identification circuit which identifies data read by said card reader, an operation circuit connected to said display and said printer, said operation circuit controlling player entry into a game and initiating and terminating a game, a random number circuit, responsive to random numbers received thereby, for issuing start/stop signals, a motor drive circuit, responsive to the start/stop signals and drive pulse signals applied thereto, for driving the stepping motors, a judgment circuit which judges matching of patterns according to the positions of the patterns detected by the detector means, and a CPU connected to said operation circuit and said judgment circuit, said CPU being connected to said card identification circuit to receive card identification data from said card identification circuit, said CPU providing the random numbers to said random number circuit and the drive pulse signals to said motor drive circuit.

4. The pattern matching game machine of a prepaid card system as claimed in claim 3 wherein each of said belt pulleys have radially extended flanges along its periphery on both sides.

* * * * *

UNITED STATES PATENT AND TRADEMARK OFFICE

CERTIFICATE OF CORRECTION

PATENT NO. : 5,135,224

DATED : August 4th, 1992

INVENTOR(S) : Hiroshi YAMAMOTO ET AL.

It is certified that error appears in the above-identified patent and that said Letters Patent is hereby corrected as shown below:

Please correct the title page as follows:

[22] Filed Jan. 14, 1991

Signed and Sealed this

Twenty-ninth Day of March, 1994

Bruce Lehman

*Attest:*

BRUCE LEHMAN

*Attesting Officer*

*Commissioner of Patents and Trademarks*